US006994233B2

(12) United States Patent
Dygert et al.

(10) Patent No.: US 6,994,233 B2
(45) Date of Patent: Feb. 7, 2006

(54) VENTED PLASTIC BOTTLE

(75) Inventors: Douglas Dygert, Olive Branch, MS (US); Patrick Staley, Ripon, CA (US); Eugene Kuhar, Bartlett, TN (US)

(73) Assignee: Ring Container Technologies, Inc., Oakland, TN (US)

( * ) Notice: Subject to any disclaimer, the term of this patent is extended or adjusted under 35 U.S.C. 154(b) by 358 days.

(21) Appl. No.: 10/619,513

(22) Filed: Jul. 16, 2003

(65) Prior Publication Data

US 2005/0011915 A1 Jan. 20, 2005

(51) Int. Cl.
*B65D 83/00* (2006.01)

(52) U.S. Cl. ..... 222/468; 222/564

(58) Field of Classification Search ..... 222/468, 222/564

See application file for complete search history.

(56) References Cited

U.S. PATENT DOCUMENTS

| | | | | |
|---|---|---|---|---|
| 3,400,846 | A | 9/1968 | Kelly | |
| 3,499,567 | A | 3/1970 | Spotts | |
| 3,729,122 | A | 4/1973 | Flider | |
| 4,412,633 | A * | 11/1983 | Guerrazzi et al. | 222/468 |
| 6,105,800 | A | 8/2000 | Czesak | |
| 6,360,924 | B1 * | 3/2002 | Franzen | 222/468 |

FOREIGN PATENT DOCUMENTS

| | | |
|---|---|---|
| EP | 01362222 | 4/1985 |

* cited by examiner

*Primary Examiner*—Philippe Derakshani
(74) *Attorney, Agent, or Firm*—Sughrue Mion, PLLC

(57) ABSTRACT

A blow molded plastic container having a circular spout and a liquid guiding neck portion with a curved, generally U-shaped pouring anti-glug ledge. A plurality of vertical reinforcing columns extend between the ledge and top wall of the container to hold the spout in a level position.

19 Claims, 2 Drawing Sheets

VENTED PLASTIC BOTTLE

BACKGROUND OF THE INVENTION

This invention relates generally to containers for dispensing liquid and more specifically to a container having a novel pouring spout arrangement by which the space above the liquid is vent ed to permit air to be drawn into the space during a pouring operation to prevent the glugging or gulping phenomenon associated with many conventional bottles.

This invention is particularly applicable to larger blow molded plastic bottles, for example 35 lb. or 5 gallon jugs, of the type described in U.S. Pat. No. 5,340,000, owned by the parent company of the assignee of this invention, and used for dispensing a variety of different types of liquids, some of which may be toxic or flammable. To eliminate the unwanted glugging action, as liquid is poured from the bottle, the bottle illustrated in U.S. Pat. No. 5,340,000 includes a neck platform 30 having a forward wall 32 including a vertical section 34 which extends along and coextensively upwardly from wall 14 and blends with a rearwardly tapered section 36 which terminates in a top wall portion 38 on which a circular threaded spout 40 is formed. The platform also includes a pair of side walls 42 and 44 which extend rearwardly from a forward wall 32 beneath the spout 40 to a junction area 46 where they join with a narrow hollow handle 50 which is connected at its rearward end 52 to the rear wall 16. The platform 30 also includes a guiding neck portion 54 which forms a horizontal generally U-shaped curved ledge 60 which extends inwardly from walls 42 and 44 to form a generally U-shaped pouring edge 70 which diverts the liquid stream away from the sides and rear of the spout, producing a smaller area but higher velocity of liquid flow over the front edge 78 of the spout while permitting air to flow into the rear of the spout through passageway 58 of handle 50 into chamber 20. The bottom surface of ledge 60 is spaced above top wall 24 to create a vertical space there between. For a more complete understanding of that bottle reference is made to U.S. Pat. No. 5,340,000 the specification of which is incorporated herein ill its entirety.

The bottle illustrated in U.S. Pat. No. 5,340,000 has enjoyed substantial commercial success and has essentially alleviated glugging action during a pouring operation. However, an occasional problem has been noted. During the cooling process of the hot, blown plastic bottle, the neck of the bottle may sometimes assume an excessively tilted position so that die top of the spout is no longer level. This causes capping and sealing problems for the bottle customer during the filling operation. The tilt problems have become more common as the thickness of the plastic material has been reduced for cost purposes and are deemed attributable to the fact that the no-glug ledge is unsupported in a vertical direction due to the open vertical space between the bottom of the ledge and the top wall of the container.

The invention as described below was developed to alleviate the tilt problems associated with the bottle described in U.S. Pat. No. 5,340,000.

SUMMARY OF THE INVENTION

The primary object of the invention is to provide a container or bottle having a novel neck arrangement including anti-glugging structure which eliminates glugging action as liquid is poured from the container and reinforcing means for maintaining the neck arrangement in a substantially level position during the manufacture and use of the container.

Still another object of this invention resides in the above container wherein the anti-glug structure includes a generally horizontal curved ledge which deflects liquid toward the front edge of the outlet spout of the bottle as the liquid is poured from the bottle, and vertical columns or ribs extending downwardly from die ledge to the top of the bottle to strengthen the neck and maintain the spout in a level position during the manufacturing and filling operations of the bottle.

Still another object of the invention resides in the provision of the above described container wherein the rearward portion of the spout communicates with a hollow handle to permit air to freely enter into the bottle as liquid is deflected toward the forward edge of the outlet spout by the anti-glug ledge.

These and other objects of the invention will become apparent from reading the following detailed description of the invention in which reference is made to the accompanying drawings wherein like numerals indicate like elements.

DETAILED DESCRIPTION OF THE INVENTION

Figure 1:
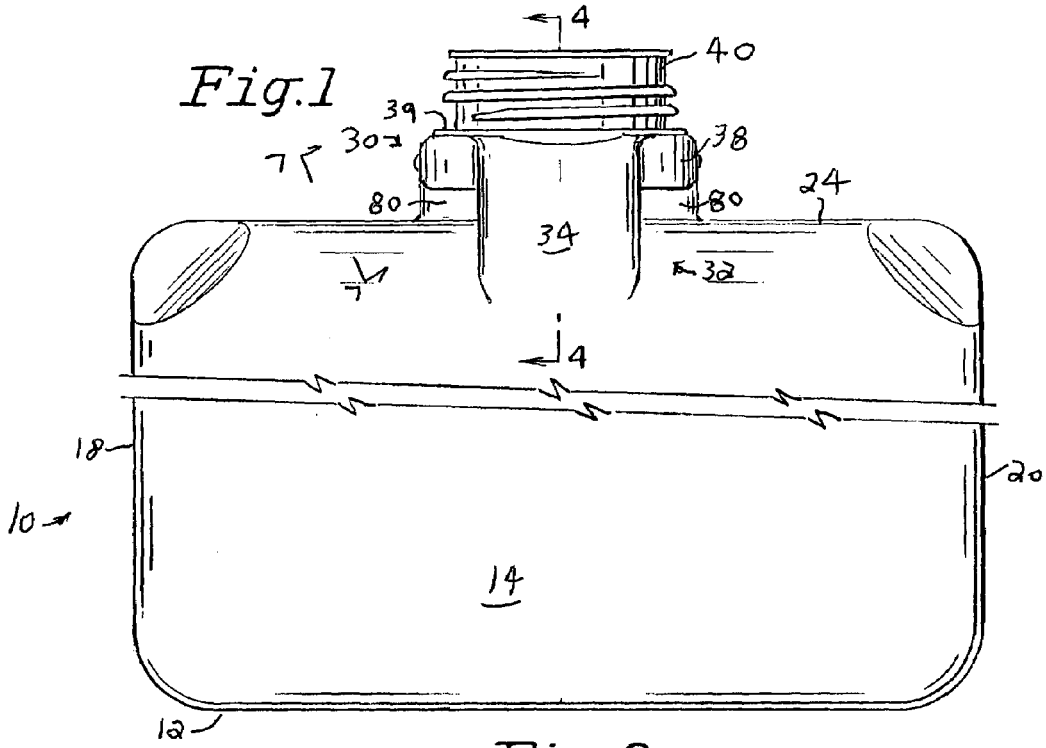
FIG. 1 is a front elevation view of the novel blown plastic bottle of the invention.

Referring now to the drawings the one piece blow molded plastic container or bottle 10 includes bottom wall 12, vertical front wall 14, rear wall 16 and side walls 18 and 20 which define a liquid containing chamber 22 of generally rectangular cross section and a top wall 24 joining walls 14, 16, 18 and 20 to close chamber 22.

Integrally formed on top of wall 24, adjacent front wall 14, is a neck platform 30 having a forward wall 32 including a vertical section 34 which extends along mid coextensively upwardly from front wall 14 and blends with a rearwardly curved section 36 that blends with a front portion of a circular side wall 38 and a flat top wall 39 on top of which is formed a circular threaded outlet spout 40 normally closed by a cap (not shown). Circular side wall 38 defines a transitional chamber 41 which extends rearwardly from wall 36 to an area where it connects to the forward end of a hollow passageway 43 of a narrow hollow handle 42 which is connected at its rearward end 44 to wall 16. The width of wall sections 34 and 36 is less than the diameter of circular wall 38.

Platform 30 also includes an anti-glug neck portion 50 formed by a generally arcuate vertical wall 52 extending upwardly from top wall 24 and terminating in a horizontal wall 54 extending horizontally outwardly to join the bottom of side wall 38. Vertical wall 52 is of a smaller circular dimension than side wall 38 so that a vertical space 55 exists between the top of top wall 24 and the bottom of horizontal wall 54.

Figure 2:
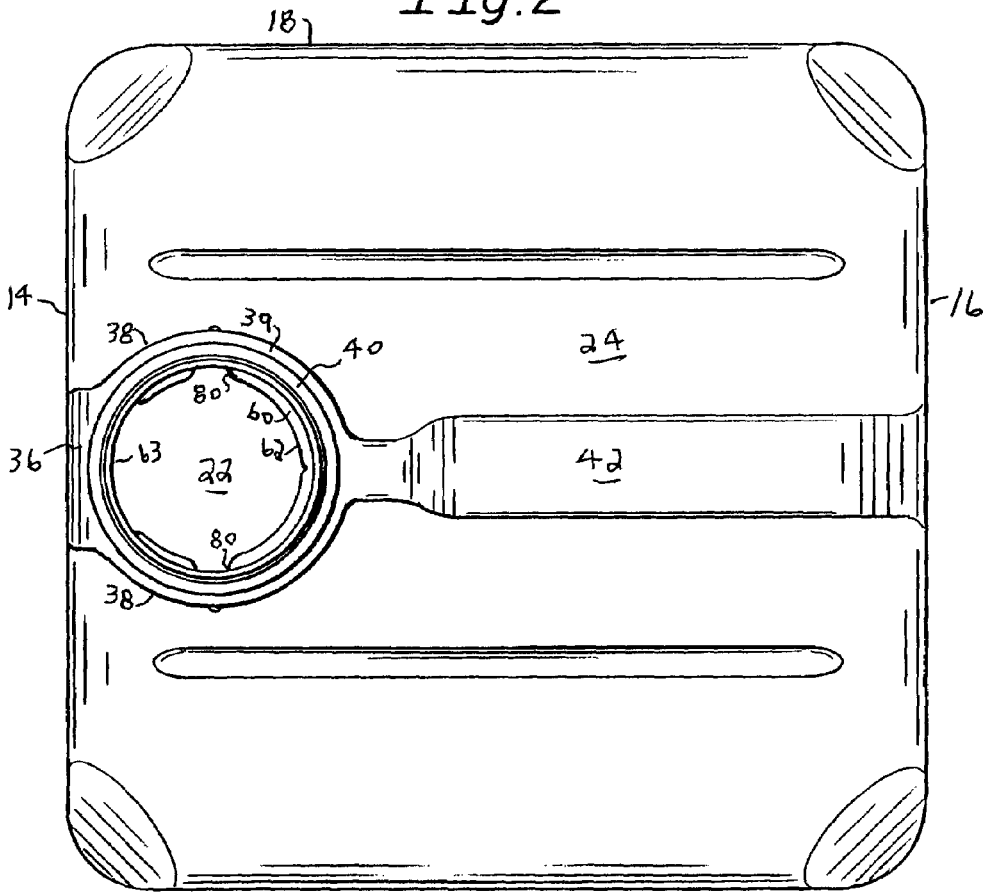
FIG. 2 is a top plan view of the bottle.
Figure 3:
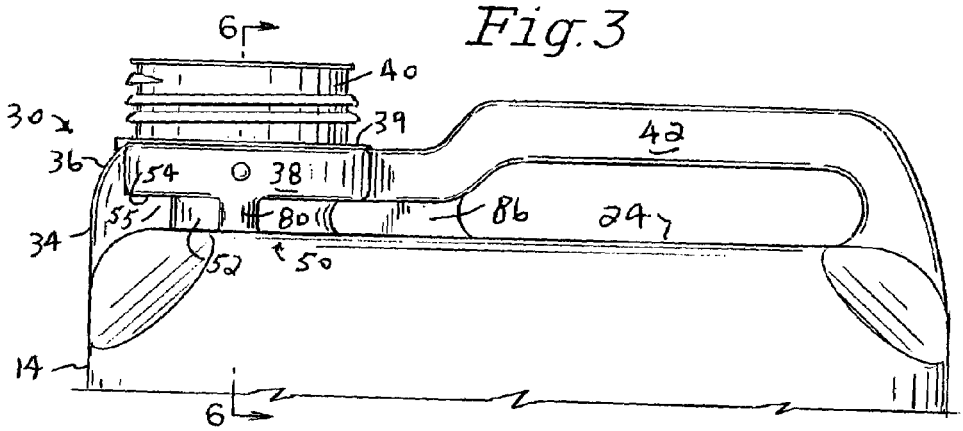
FIG. 3 is a side elevational view of the bottle.
Figure 4:
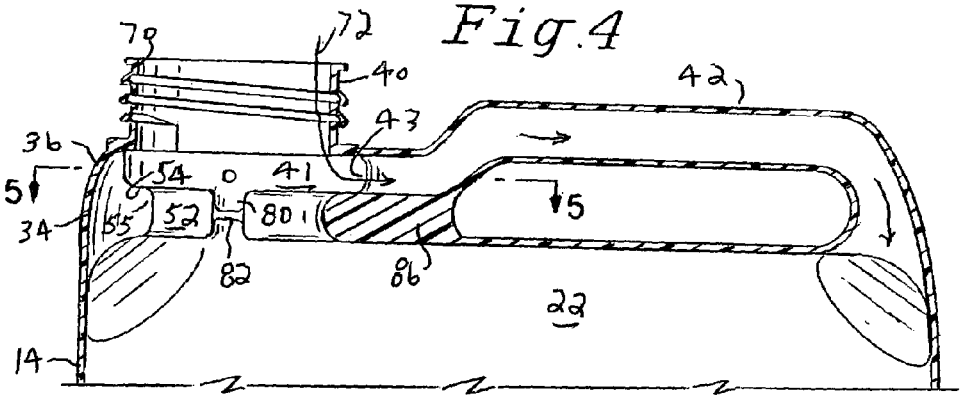
FIG. 4 is a fragmentary sectional view taken along line 4—4 of FIG. 1.
Figure 5:
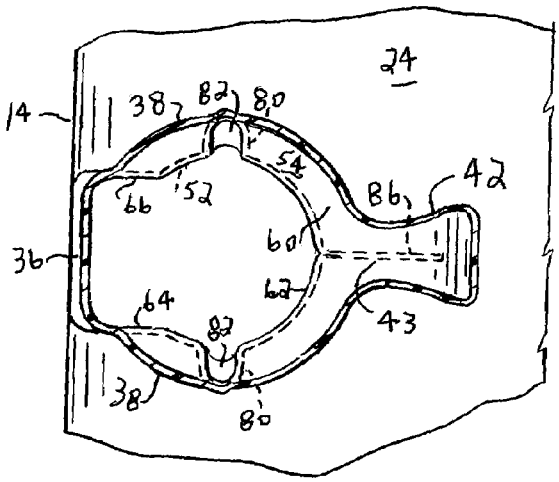
FIG. 5 is a fragmentary sectional plan view taken along line 5—5 of FIG. 4.
Figure 6:
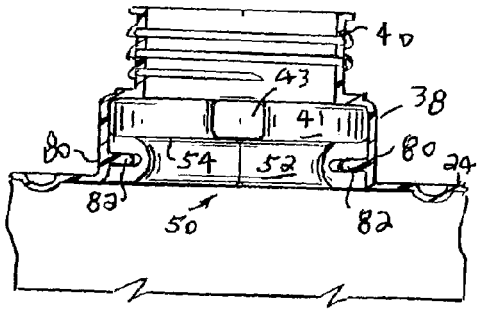
FIG. 6 is a fragmentary sectional elevational view taken along line 6—6 of FIG. 3.
Figure 7:
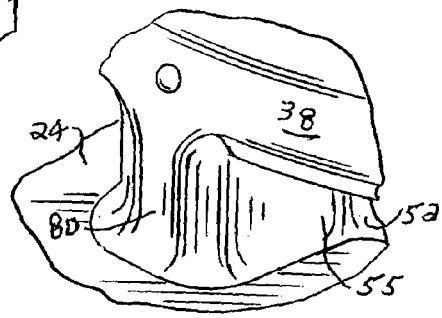
FIG. 7 is a fragmentary enlarged perspective view of the reinforcing column or rib taken generally along line 7—7 of FIG. 1.

As best seen in FIGS. 2–6 the guiding no-glug portion 50 forms a horizontal, generally circular ledge 60 below wall 38 at the bottom opening to spout 40, with the inner edge 62 of ledge 60 being spaced inwardly from the inner edge 63 of spout 40. The front portions 64 and 66 of pouring edge 62 diverge outwardly to intersect with side wall 38 adjacent the front walls 34 and 36. Consequently, as liquid is poured from chamber 22 to the bottom opening of platform 30, the edge 62 deflects and guides the liquid into the front portion of chamber 41 and over the front edge 70 of spout 40. This permits air indicated by arrow 72 to enter the rear portion of the spout into passageway 41 and opening 43 through the hollow handle 42 into chamber 22, thereby preventing the unwanted glugging action.

As an improvement over the bottle construction illustrated in U.S. Pat. No. 5,340,000 one or more outwardly extending vertical U-shaped ribs or columns 80 are formed integrally with and as interruptions in wall 52 to provide vertical reinforcement and support between the bottom of ledge 60 and the top wall 24, with a horizontal bar 82 integrally molded within the column 80 at a location midway between the top and bottom thereof to further reinforce the column. Preferably there are two columns 80 located on the diametral center line of circular wall 38 and spout 40 which extends laterally between the side walls 18 and 20 of bottle 10. A vertical reinforcing web 86 is also integrally molded between the bottom of the forward portion of hollow handle 42 and the top of wall 24.

Vertical columns 80 overcome the tilt problems associated with the unsupported neck construction described in U.S. Pat. No. 5,340,000. The columns add rigidity to the neck and help keep the no-glug ledge 60 and the top of spout 40 level as the hot blown plastic bottle is cooled. In addition, columns 80 help retain the spout 40 in a level position when engaged by the automatic capping and filling machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A plastic container comprising a bottom wall, front, rear, and side walls extending vertically from said bottom wall defining a chamber, a top wall covering a substantial portion of said chamber, a neck platform extending upwardly from said top wall adjacent said front wall and having a circular pouring spout with an open end, means connected to said platform defining an air passageway from said spout to said chamber, said platform including a guiding neck portion connected to said top wall below said spout and having a curved horizontal ledge as viewed from the open end of said spout and opening toward said front wall, whereby during a pouring operation said ledge directs liquid from said chamber over the front edge of said spout away from the rear edge of said spout thereby permitting air to enter the rear of said spout into said air passageway and said chamber, said ledge extending outwardly from the axis of the spout and being vertically spaced above said top wall, and vertical reinforcing means extending between said ledge and said top wall to hold said spout in a substantially level position.

2. The plastic container of claim 1, said reinforcing means including a plurality of vertical columns spaced around said ledge.

3. The plastic container of claim 2, said columns being located on a diametral line of said spout which is generally parallel to said front wall.

4. The plastic container of claim 3, said columns being formed as outwardly curved interruptions in said ledge.

5. The plastic container of claim 4, comprising a horizontal reinforcing bar molded within each interruption.

6. The plastic container of claim 3, wherein said means defining said air passageway is a hollow handle extending from said platform to said rear wall.

7. The plastic container of claim 6, comprising a vertical reinforcing web extending between the front of said handle and said top wall.

8. A plastic container comprising a bottom wall, side wall means extending vertically from said bottom wall defining a chamber, a top wall covering a substantial portion of said chamber, a neck platform extending upwardly from said top wall and having a circular pouring spout with an open end, means connected to said platform defining an air passageway from said spout to said chamber, said platform including a guiding neck portion connected to said top wall below said spout and having a curved horizontal ledge as viewed from the open end of said spout and opening toward said front wall, whereby during a pouring operation said ledge directs liquid from said chamber over the front edge of said spout away from the rear edge of said spout thereby permitting air to enter the rear of said spout into said air passageway and said chamber, said ledge extending outwardly from the axis of the spout and being vertically spaced above said top wall, and vertical reinforcing means extending between said ledge and said top wall to hold said spout in a substantially level position.

9. The plastic container of claim 8, said reinforcing means including a plurality of vertical columns spaced around said ledge.

10. The plastic container of claim 9, said columns being located on a laterally extending diametral line of said spout.

11. The plastic container of claim 10, said columns being formed as outwardly curved interruptions in said ledge.

12. The plastic container of claim 11, comprising a horizontal reinforcing bar molded within each interruption.

13. The plastic container of claim 9, wherein said means defining said air passageway is a hollow handle extending from said platform to said rear wall.

14. The plastic container of claim 13, comprising a vertical reinforcing web extending between the front of said handle and said top wall.

15. A plastic container comprising a bottom wall, front, rear, and side walls extending vertically from said bottom wall defining a chamber, a top wall covering a substantial portion of said chamber, a neck platform extending upwardly from said top wall adjacent said front wall and having a circular pouring spout with an open end, a hollow handle connected to said platform defining an air passageway from said spout to said chamber, said platform including a guiding neck portion connected to said top wall below said spout and having a curved horizontal ledge as viewed from the open end of said spout and opening toward said front wall, whereby during a pouring operation said ledge directs liquid from said chamber over the front edge of said spout away from the rear edge of said spout thereby permitting air to enter the rear of said spout into said air passageway and said chamber, said ledge extending outwardly from the axis of the spout and being vertically spaced above said top wall, and a plurality of vertical reinforcing columns extending between said ledge and said top wall to hold said spout in a substantially level position.

16. The plastic container of claim 15, said columns being located on a diametral line of said spout which is generally parallel to said front wall.

17. The plastic container of claim 16, said columns being formed as outwardly curved interruptions in said ledge.

18. The plastic container of claim 17, comprising a horizontal reinforcing bar molded within said each interruption.

19. The plastic container of claim 15, comprising a vertical reinforcing web extending between the front of said handle and said top wall.

* * * * *